US006003253A

United States Patent [19]

Abplanalp

[11] Patent Number: 6,003,253

[45] Date of Patent: Dec. 21, 1999

[54] METHOD OF MOUNTING A FABRIC CLOTH TO BE PAINTED IN A STRETCHED MANNER AND APPARATUS FOR PRACTICING SUCH METHOD

[75] Inventor: Jürg Werner Abplanalp, Zurich, Switzerland

[73] Assignee: ICPC Trading Co., Ltd., Zug, Switzerland

[21] Appl. No.: 09/087,860

[22] Filed: Jun. 1, 1998

[30] Foreign Application Priority Data

Mar. 6, 1997 [CH] Switzerland ..... 1324/97

[51] Int. Cl.[6] ..... D06C 3/08; D06C 3/10

[52] U.S. Cl. ..... 38/102.91; 38/102.1; 160/404

[58] Field of Search ..... 38/102, 102.91; 160/374.1, 377, 378, 382, 399, 383, 384, 403, 404, 398; 101/127.1

[56] References Cited

U.S. PATENT DOCUMENTS

| | | | |
|---|---|---|---|
| 1,277,725 | 9/1918 | Hopper | 38/102.91 |
| 2,037,991 | 4/1936 | Mavity | 39/102.91 |
| 3,886,990 | 6/1975 | Campione | 38/102.91 X |
| 3,915,655 | 10/1975 | Ogino | 160/382 X |
| 4,322,901 | 4/1982 | Spitzke | 38/102.91 X |
| 4,934,974 | 6/1990 | Jarosz et al. | 38/102.91 X |
| 5,056,247 | 10/1991 | Loomie | 38/102.91 |

FOREIGN PATENT DOCUMENTS

| | | | |
|---|---|---|---|
| 2667541 | 4/1992 | France | 38/102 |

*Primary Examiner*—Ismael Izaguirre
*Attorney, Agent, or Firm*—Laurence R. Brown

[57] ABSTRACT

The mounting and stretching of a fabric cloth at a distance from a base proceeds by utilization of mounting bodies made of cardboard mounted adhesively onto the base. The cloth is stretched over the upper edges of the mounting bodies and is temporarily mounted by pins.

9 Claims, 2 Drawing Sheets

METHOD OF MOUNTING A FABRIC CLOTH TO BE PAINTED IN A STRETCHED MANNER AND APPARATUS FOR PRACTICING SUCH METHOD

BACKGROUND OF THE INVENTION

1. Field of the Invention

The present invention relates to a method of mounting a fabric cloth to be painted in a stretched manner, specifically a silk cloth, at a distance above a base. It relates further to a apparatus for practicing such method.

2. Description of the Prior Art

When painting a fabric cloth, specifically when performing the so-called silk painting it is of a large importance that the fabric cloth does not abut or contact the base at any location, because then the paint deposited would flow through at the areas of the contact under the contours of the figures to be painted, the so-called Gutta-contours.

This problem has been solved until now by complicated clamping or stretching frames for pieces of cloth to be painted.

SUMMARY OF THE INVENTION

It is a general object of the present invention to provide a novel mounting method and mounting body for practicing such method which allow a simple, extremely low cost and nevertheless reliable mounting of the pieces of cloth.

A further object is to provide a method comprising the steps of mounting a plurality of inherently stiff mounting bodies made of cardboard at least temporarily along a clamping line onto the base aligned relative to each other, of thereafter placing the fabric cloth onto the mounting bodies and affixing it thereto at least temporarily by means of mounting members, and of imparting a desired stretch onto the fabric cloth during the affixing thereof.

A further object is to provide a mounting body which is structured as a strip of cardboard formed to a wedge shaped body, which cardboard strip is divided by folding lines into at least four discreet area portions of which portions one portion forms the basis of the wedge and the other ones serve by a folding around the folding lines for the forming of the two remaining side surfaces, and whereby portions of the outer side of the area portions are coated by a adhesive agent.

The basic idea of the present invention is to place instead of the complicated clamping frames a number of mounting bodies, so-called clamping triangles made of cardboard onto the base and to affix them to the base in order to thereafter mount the edges of the fabric cloth to be painted e.g. by means of pins onto the upper edges of the clamping triangles, by means of which the necessary stretching of the cloth is obtained.

The apparatus for generally practicing this invention includes apart from a suitable base a set of mounting bodies or mounting triangles, resp. or merely simple strips of cardboard which allow a producing of such mounting bodies by only a few manipulations.

A part of the outer surface of the cardboard strips is equipped with an adhesive agent, e.g. in form of a double side adhesive tape. This allows a simple assembling of the mounting bodies or clamping triangles, resp. and their affixing to the base. The mounting bodies all are set with the upper edge parallel to the edge of the cloth (clamping or stretching line), so that it is possible to retighten the cloth in the measure of the length of a upper edge on both sides by a simple shifting of the replacing of the pins in case that such should be necessary at all.

The number of clamping triangles needed depends from the size of the cloth. For a size of 90×90 centimeters an estimated 12–15 clamping triangles are needed.

BRIEF DESCRIPTION OF THE DRAWINGS

The present invention will be better understood and objects other than those set forth will become apparent when consideration is given to the following detailed description thereof when read in conjunction with the following drawings, and wherein.

DETAILED DESCRIPTION OF A PREFERRED EMBODIMENT

Figure 1:
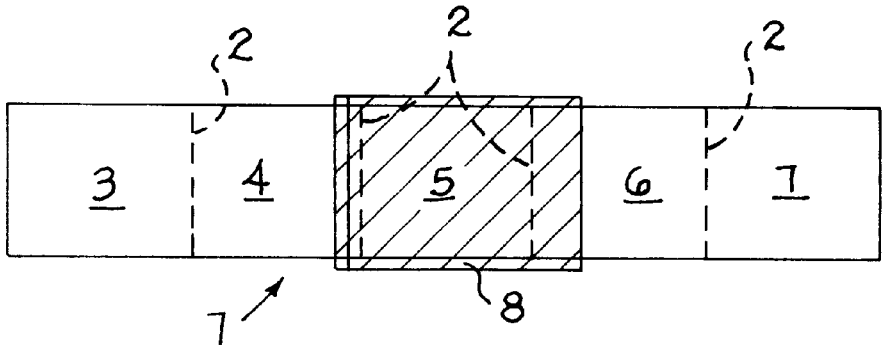
FIG. 1 is a top view of the outer side of a strip of cardboard used for the forming of a clamping body.

FIG. 1 of the drawing illustrates on a scale of about 1:2 a cardboard strip 1 for a forming of a mounting body (clamping or stretching triangle). The strip 1 is divided by folding lines 2 into five surface portions 3–5, whereby a double sided adhesive tape 8 with a covering protective foil 9 (FIG. 2) is mounted at the center area (center portion 5 and edge areas of the adjoining surface portions 4 and 6, resp.).

Figure 2:
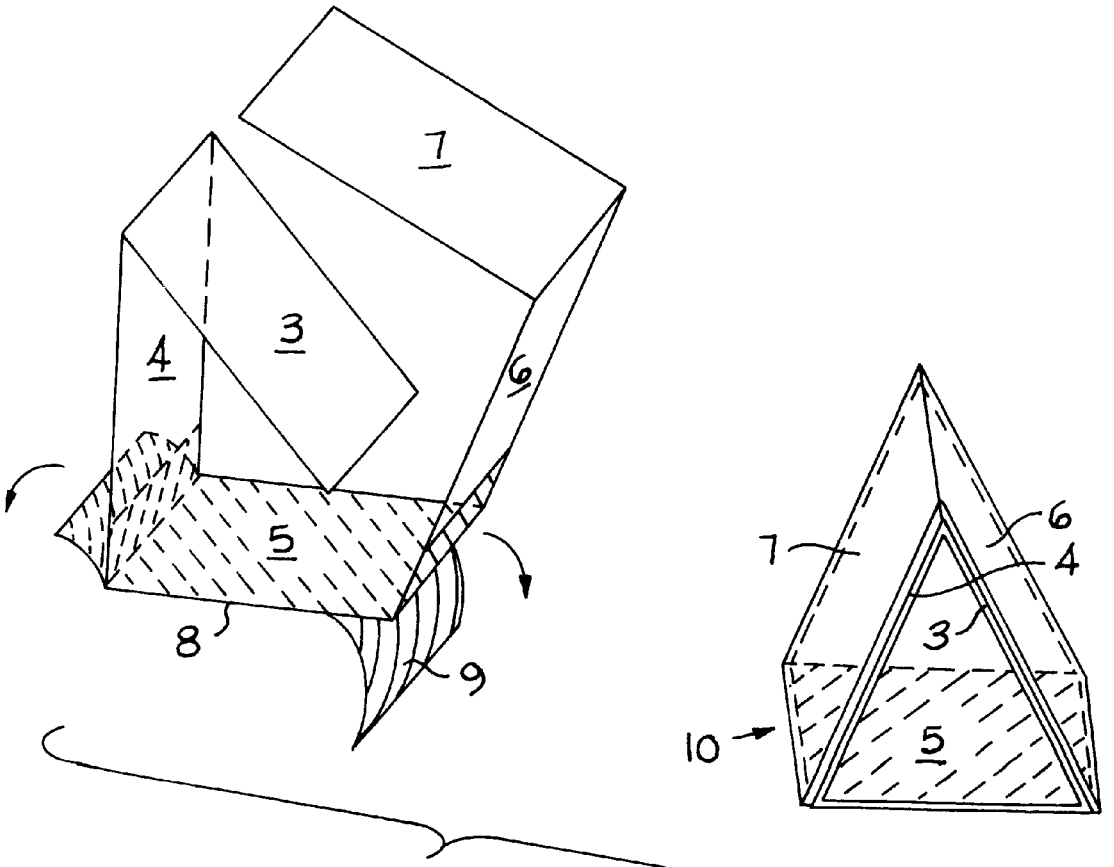
FIG. 2 illustrates on a schematic basis only the forming of a clamping body from a strip of cardboard according to FIG. 1.

FIG. 2 illustrates how a so called clamping triangle 10 is formed from the cardboard strip 1. Due to portions 3,4 and 6,7 resp. located respectively at both sides of the portion 5 and covering each other after the assembling thereof, a quite rigid (inherently stiff) structure is obtained of which one surface portion (base surface 5) is covered at its outer side by an adhesive agent for a affixing to a base.

Figure 3:
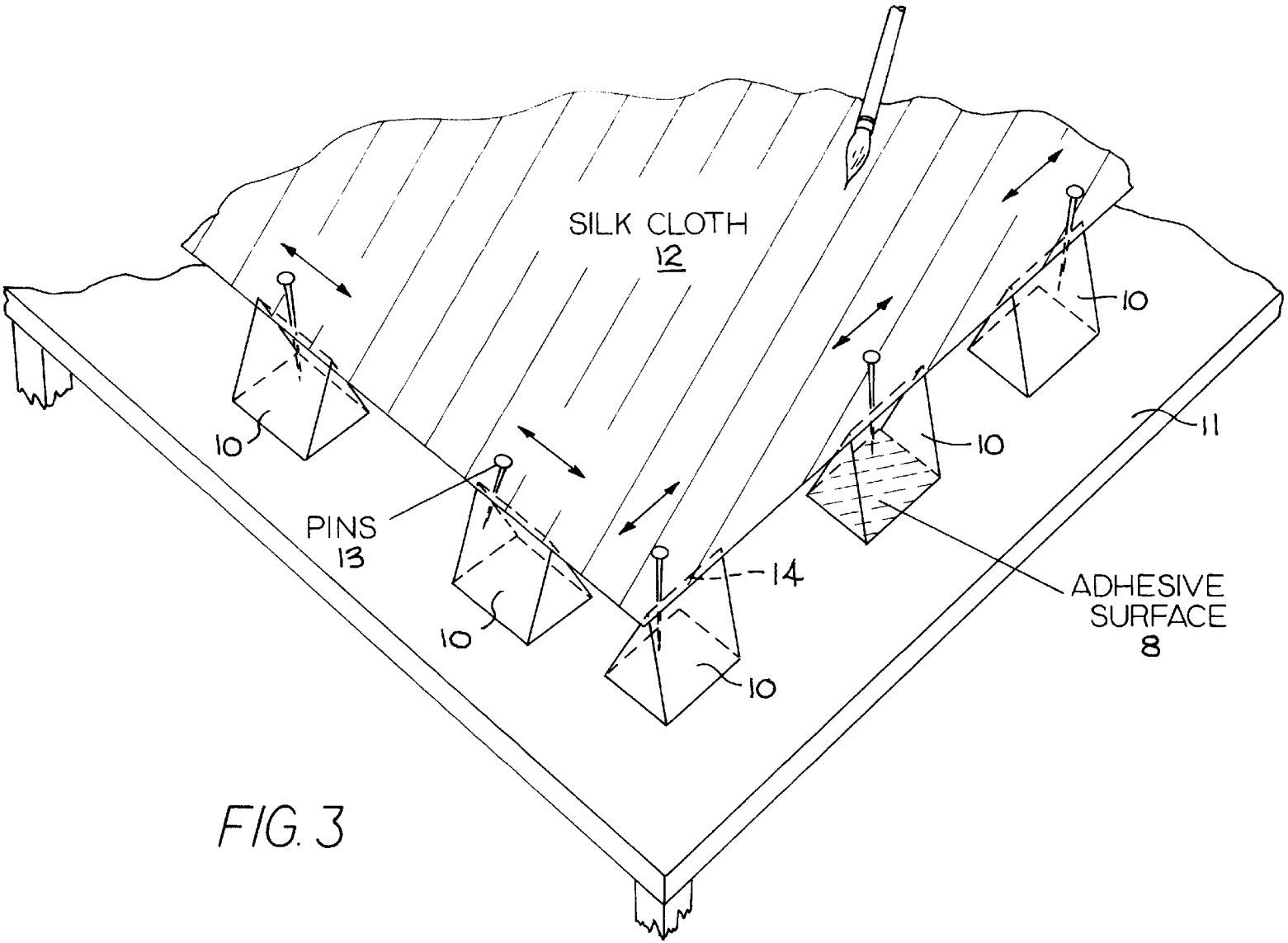
FIG. 3 illustrates a cut out portion of a mounted silk cloth.

FIG. 3 illustrates how a number of the mounting bodies 10 are adhesively mounted on a base 11 aligned with each other and placed along the desired stretching or clamping line (extent of the edge of a silk cloth 12) and how a silk cloth 12 is mounted in view of getting painted by means of pins 13 in a desired stretched state to the upper edges 14 of the bodies 10.

While there is shown and described a present preferred embodiment of the invention it shall be distinctly understood that the invention is not limited thereto and can be variously practiced and embodied within the scope of the following claims.

It is claimed:

1. A method of mounting a fabric cloth to be painted in a stretched manner at a distance above a base member, comprising the steps of mounting a plurality of stiff mounting bodies made of cardboard at least temporarily along a desired clamping line onto said base member and aligned relative to each other, of thereafter placing the fabric cloth onto said mounting bodies and affixing it thereto at least temporarily by means of mounting members, and of imparting a desired stretch onto said fabric cloth during the affixing thereof.

2. The method of claim 1, further comprising the step of mounting said mounting bodies onto said base member by adhesively mounting the mounting bodies thereto.

3. The method of claim 1, wherein pins are used as said mounting members for affixing the fabric cloth onto said mounting bodies.

4. The method of claim 1, wherein stiff wedges having a base surface are formed of a strip of cardboard for use as mounting bodies, and a plurality of wedges are mounted aligned relative to each other by their base surfaces on said base member in such a manner that edges presented by the mounting bodies adjacent the base surfaces extend along said clamping line.

5. The method of claim 1, including the step of structuring each mounting body from a strip of cardboard to form a wedge shaped body, wherein the cardboard strip is divided at folding lines into at least four discreet area portions of which portions one forms a base of the wedge and the other ones are folded around the folding lines to form two remaining side surfaces, and coating portions of the outer sides of the area portions with an adhesive agent.

6. The method of claim 1 wherein the fabric cloth is a silk cloth.

7. A mounting body for mounting a fabric body to be painted at a distance above a base member, comprising in combination:

a wedge shaped body formed from a strip of cardboard, wherein the cardboard strip is folded along folding lines into at least three discreet area portions, wherein one portion forms a base of the wedge shaped body and the other portions are folded at the folding lines to form two remaining side surfaces, and wherein outer side of the portions are coated with an adhesive agent.

8. The mounting body of claim 7, wherein each cardboard strip is divided into five consecutive area portions providing a center portion forming a base area and two portions adjoining the base area at two sides forming thereby a saddle roof, and wherein the two portions joining the base area have the adjacent area portions folded over to form double thickness area portions on two wedge sides, and outer ones of the area portions are adhesively mounted to inner area portions located thereunder.

9. The mounting body of claim 7, with a pressure sensitive adhesive agent covered by a protective foil.

* * * * *